US011560868B2

(12) United States Patent
Schmieder et al.

(10) Patent No.: US 11,560,868 B2
(45) Date of Patent: Jan. 24, 2023

(54) INJECTOR FOR INJECTING A FLUID, HAVING A TAPERING INFLOW AREA OF A THROUGH-OPENING

(71) Applicant: Robert Bosch GmbH, Stuttgart (DE)

(72) Inventors: Dietmar Schmieder, Markgroeningen (DE); Philipp Rogler, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 153 days.

(21) Appl. No.: 16/308,666

(22) PCT Filed: Jun. 14, 2017

(86) PCT No.: PCT/EP2017/064584

§ 371 (c)(1),
(2) Date: Dec. 10, 2018

(87) PCT Pub. No.: WO2018/001741

PCT Pub. Date: Jan. 4, 2018

(65) Prior Publication Data

US 2019/0309720 A1 Oct. 10, 2019

(30) Foreign Application Priority Data

Jun. 29, 2016 (DE) ..... 102016211688.6

(51) Int. Cl.
*F02M 61/18* (2006.01)
*F02M 61/10* (2006.01)

(52) U.S. Cl.
CPC ..... *F02M 61/1833* (2013.01); *F02M 61/10* (2013.01); *F02M 61/18* (2013.01); *F02M 61/1806* (2013.01)

(58) Field of Classification Search
CPC ..... F02M 61/1806; F02M 61/1833; F02M 61/184; F02M 61/1846; F02M 61/10
See application file for complete search history.

(56) References Cited

U.S. PATENT DOCUMENTS

2002/0158152 A1* 10/2002 Hockenberger ... F02M 61/1833 239/533.12
2003/0094518 A1* 5/2003 Abe ..... F02M 61/162 239/585.4

(Continued)

FOREIGN PATENT DOCUMENTS

DE 112012006103 T5 12/2014
EP 1816342 A1 8/2007

(Continued)

OTHER PUBLICATIONS

International Search Report for PCT/EP2017/064584, dated Jul. 13, 2017.

*Primary Examiner* — Cody J Lieuwen
(74) *Attorney, Agent, or Firm* — Norton Rose Fulbright US LLP; Gerard Messina

(57) ABSTRACT

An injector for injecting a fluid, including a valve seat, on which a sealing area is situated, and a closing element, which is situated on an injector center line and which, on the valve seat, releases and closes at least one through-opening, the at least one through-opening having a main axis at an angle of inclination with respect to the injector center line, the at least one through-opening having an inflow area, and the inflow area having a tapering design.

10 Claims, 3 Drawing Sheets

(56) References Cited

U.S. PATENT DOCUMENTS

| | | | | |
|---|---|---|---|---|
| 2004/0262430 | A1* | 12/2004 | Joseph | F02M 61/168<br>239/533.12 |
| 2006/0144958 | A1* | 7/2006 | Fukutomi | F02M 61/162<br>239/88 |
| 2015/0047611 | A1* | 2/2015 | Yasukawa | F02M 51/0671<br>123/445 |
| 2015/0285201 | A1* | 10/2015 | Serizawa | F02M 61/184<br>239/584 |
| 2016/0025057 | A1* | 1/2016 | Kato | F02M 61/1886<br>239/584 |
| 2016/0319792 | A1* | 11/2016 | Agresta | F02M 61/1846 |

FOREIGN PATENT DOCUMENTS

| | | | |
|---|---|---|---|
| EP | 2884090 | A1 | 6/2015 |
| JP | S56118967 | U | 9/1981 |
| JP | 2004353661 | A | 12/2004 |
| JP | 2006528302 | A | 12/2006 |
| JP | 2008128130 | A | 6/2008 |
| JP | 2010236391 | A | 10/2010 |
| JP | 2016008550 | A | 1/2016 |

* cited by examiner

I-I

INJECTOR FOR INJECTING A FLUID, HAVING A TAPERING INFLOW AREA OF A THROUGH-OPENING

FIELD

The present invention relates to an injector for injecting a fluid, in particular a fuel, having a reduced pressure drop and including a self-centering closing element of a valve seat.

BACKGROUND INFORMATION

Injectors which inject fluids into a volume space, such as fuels into an internal combustion engine, are available. Conventional designs encompass housings including movable closing elements accurately fitting a respective valve seat, for example a valve needle, for opening and closing the injector, for example regulated by a piezo actuator or an electromagnet as a solenoid valve.

The related art of injection furthermore includes that the fluid is injected into a combustion chamber via usually multiple through-openings which are released by an inwardly opening valve needle. A combustible air/fuel mixture is formed and ignited in the combustion chamber.

For manufacturing reasons, the provided through-openings are conventionally created from the outside of the injector to the inside, for example laser-drilled or with the aid of spark erosion. Due to the manufacturing process, this creates sharp-edged inner sides of the through-openings, which consequently results in disadvantageously high flow losses with a high pressure drop. This, not least in the application of a high pressure injection, may result in deviations from an ideally preferably centric course of the movable closing element and its decentering, in particular a drift. Even very small deviations or oblique positions in the injector may result in fluctuation behavior and non-optimal spray patterns of the injected fluid. This, for example in the case of a fuel, disadvantageously affects emissions and fuel consumption.

Furthermore, it has been found that decentering, in particular a drift, of the movable closing element negatively influences the wear behavior of the injector.

SUMMARY

An example injector according to the present invention for injecting a fluid, in particular a fuel, may have the advantage over the related art that reduced flow losses are possible, with a reduced pressure drop and a self-centering closing behavior of the closing element of the valve seat. In this way, it may be ensured that a course of the closing element causing excessive wear may be avoided.

It is also possible to adhere to a spray pattern to be achieved of the fluid injected into a volume space, in particular into a combustion chamber, with lower deviations from the setpoint behavior with respect to drop size distributions and trajectories. The present invention, thus, may have the advantage of favorably influencing the hydrodynamic conditions in the area of the injection to optimize the inflow behavior and/or the spraying of the fluid injected downstream from the valve seat.

In the case of a preferred fuel injector in accordance with the present invention, this furthermore has a favorable effect on the operating behavior of the internal combustion engine and with respect to a considerable reduction of emissions. Moreover, maintenance intervals and the service life are extended very positively.

All these advantages may be achieved by example embodiments of an injector according to the present invention for injecting a fluid which includes a valve seat, on which a sealing area is situated, and a closing element. The closing element, for example a linearly movable valve needle, is situated on an injector center line and is moved to release and re-close at least one through-opening on the valve seat, frequently a geometric arrangement of multiple through-openings. The at least one through-opening has a main axis at an angle of inclination with respect to the injector center line. Furthermore, the at least one through-opening has an inflow area, the inflow area having a tapering design.

Preferred refinements of the present invention are described herein.

One preferred embodiment provides that a flow cross section of the inflow area situated transversely to the main axis continuously decreases in the flow direction. On the other hand, it may also be preferred that there is at least one section in an inflow area tapering overall from the front to the back in the flow direction in which the flow cross section remains constant, so that a cylindrical circumferential shape of the overall tapering inflow area results therefrom in this particular section. In addition or as an alternative, the inflow area tapering overall in the flow direction may also have a profiled inner circumferential surface, for example designed in a wave shape and/or a stair shape.

Preferably, the inflow area, as with a funnel, may be designed as an inner hollow cone having a taper angle $\alpha$ of the inner wall with respect to a cone center line. In such a case as well, it may be provided that the inner circumferential surface of such an inner hollow cone could be designed not only to be smooth, but also in a profiled manner.

Moreover, the cone center line preferably intersects the main axis of the through-opening at a tilt angle $\delta$.

In the geometrically simplest case, which shall not be considered to be limiting to the present invention, the cone center line and the main axis of the through-opening preferably coincide. This corresponds to a tilt angle $\delta$ selected to be zero. In such a possible specific embodiment, in the section with a plane E1, which by definition within the scope of the present invention is spanned by the entrance flow cross section of the inflow area, a round entrance circumferential contour results in the same plane E1. A center of a circle of the round entrance circumferential contour is thus situated in the intersecting point of the cone center line and the main axis with plane E1.

This results in further multiple advantages for different aspects of the operating behavior of the injector itself or the processes taking place downstream, in particular on the hydrodynamic and/or thermal and/or mechanical processes.

Furthermore, the entrance flow cross section of the inflow area defining a plane E1 may have an entrance circumferential contour in this same plane, plane E1, which is preferably not round. In principle, all types of non-circular entrance circumferential contours may be implemented. The reason is that it is possible in modern 3D-controlled mechanical production machinery to separately activate multiple degrees of freedom of the tools implementing the contour. In addition to conventional machining tools, such as milling heads, within the scope of the present invention the contour-implementing tools are furthermore EDM dies, EDM wires and/or laser treatments.

By utilizing the 3D degrees of freedom, it is also possible to implement non-circular circumferential contours, which are characterized not only by convex, but also by concave portions.

In particularly preferred specific embodiments of a non-circular entrance circumferential contour, it has an oval design in plane E1.

In one preferred specific embodiment, this may result with the geometric configuration of a rotation-symmetrical inner hollow cone due to its inclination with respect to the main axis of the through-opening by a tilt angle δ. The oval circumferential contour would then correspond to the sectional view in plane E1.

However, it may also be preferred, as an alternative, in further specific embodiments that the inner hollow cone is not designed to be rotation-symmetrical with respect to a cone center line, but asymmetrical, and not with a constant taper angle α of the inner wall.

In contrast, it may thus be preferred that the inner hollow cone includes different sub-sections of the inner wall having varied taper angles α. These sub-sections of the inner wall may be defined as follows as a function of the inscribed angle.

And in particular, initially a first circumferential point A closest to the main axis of the through-opening is determined on the entrance circumferential contour in plane E1, for which a inscribed angle γ equal to zero is defined in plane E1 about the main axis. First circumferential point A thus serves as the starting coordinate for inscribed angle γ, for example clockwise about the main axis.

Preferred embodiments provide that taper angle α is designed to be variable with inscribed angle γ.

In the case of a non-circular entrance circumferential contour, furthermore at least one second circumferential point B situated the farthest away from the main axis of the through-opening must then exist. Depending on the specific embodiment, it may be situated at an arbitrary inscribed angle γ with respect to first circumferential point A in plane E1. In particularly preferred specific embodiments, second circumferential point B is situated with respect to first circumferential point A at an inscribed angle γ equal to 180°.

Furthermore, it may preferably be provided that the inflow area is designed in the shape of an asymmetrically distorted inner hollow cone.

This is present as a further preferred embodiment in that at least one further, concave sub-section, i.e., having a decreasing taper angle α, adjoins at least one first, convex sub-section, i.e., having an increasing taper angle α, for example in the inscribed angle segment between first circumferential point A and second circumferential point B.

The further sub-section may close the circumference to a full circle, for example as a single further sub-section between second circumferential point B and first circumferential point A. As an alternative, further convex or concave sub-sections may follow the further sub-section starting in second circumferential point B. In this way, a further preferred specific embodiment for an entrance circumferential contour of the inflow area which is variable with inscribed angle γ is described in plane E1.

According to one advantageous refinement, the through-opening is subdivided into discrete areas, which are characterized by different flow cross sections. In this way, it is possible to influence the flow through the entire through-opening in an even more targeted form, downstream from the tapering inflow area, for the enhanced elimination of the disadvantages of the related art.

Preferably, the through-opening in the flow direction downstream from the inflow area thus includes an intermediate flow area having an intermediate flow cross section. Furthermore, the through-opening, preferably downstream from the intermediate flow area, includes an exit flow area having an exit flow cross section.

It is particularly preferred that the narrowest flow cross section of the through opening is situated in the area of the intermediate flow cross section.

Preferably, the intermediate flow area and/or the exit flow area is/are designed cylindrically with respect to the main axis. One essential advantage of a cylindrical configuration is the simple production, for example with the aid of a rotating drilling or milling head.

However, this shall not be considered to be limiting to the present invention. In particular, depending on the rheology of the fluid to be injected, it may also be preferred that the intermediate flow area and/or the exit flow area are designed with variable flow cross sections, in particular in a tapering manner or, on the contrary, in an expanding manner again.

Furthermore, the dimensioning of the areas having different flow cross sections may be configured in a diverse, but nonetheless deliberate manner, in relation to one another.

Preferably, the inflow area thus defines an inflow length, the intermediate flow area defines an intermediate length, and the exit flow area defines an exit length. It may, in particular, be preferred that the inflow length and the intermediate length are similar in size with respect to one another or equal in length.

In addition or as an alternative, the exit length may be larger than the inflow length and/or the intermediate length. The relation of the exit length to at least one such last-mentioned length may, in particular, be selected to be approximately by a factor of 1.3 to 2.3, still more preferably by 1.4 to 1.7.

The injector according to the present invention is particularly preferably a fuel injector for injecting a fuel, in particular a liquid fuel.

BRIEF DESCRIPTION OF THE DRAWINGS

One preferred exemplary embodiment of the present invention is described in greater detail hereafter with reference to the figures.

DETAILED DESCRIPTION OF EXAMPLE EMBODIMENTS

Figure 1:
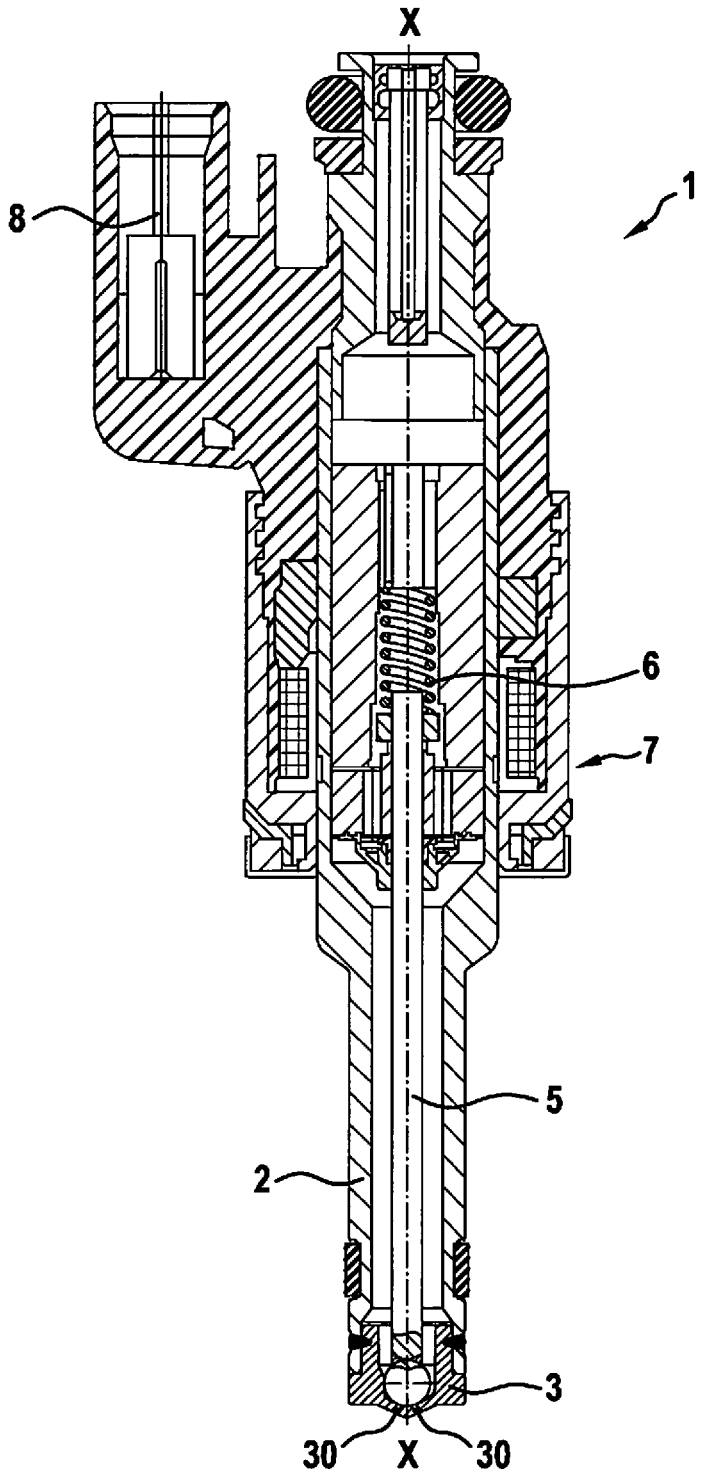
FIG. 1 shows a schematic sectional view of an injector according to one preferred exemplary embodiment of the present invention.

In the figures, identical reference numerals in each case make reference to identical elements.

Figure 2:
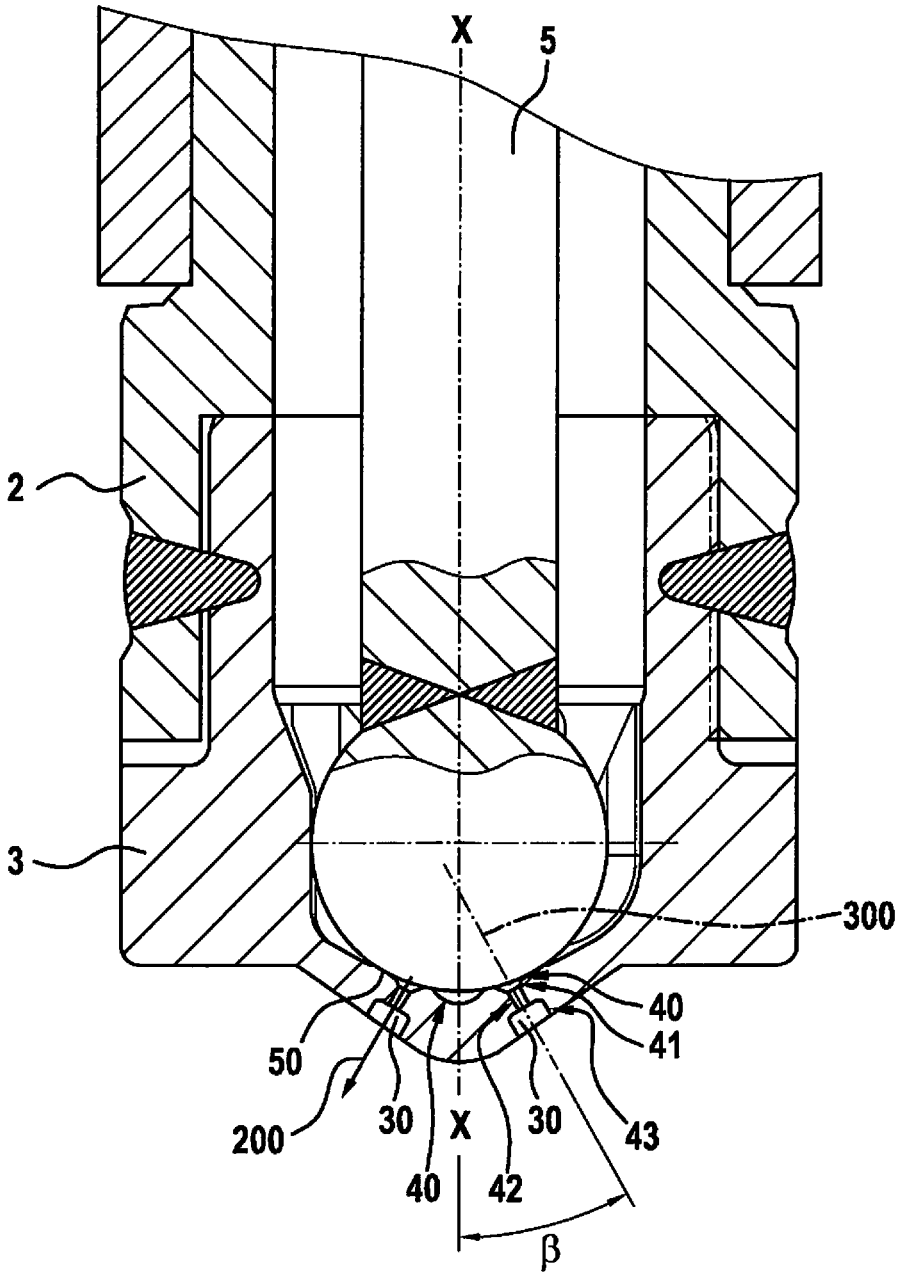
FIG. 2 shows a schematic, enlarged sectional view of a valve seat of the injector from FIG. 1, including encompassed through-openings.

As shown in FIGS. 1 and 2, an injector 1 according to one preferred exemplary embodiment of the present invention includes a valve housing 2 and a valve seat 3. Valve seat 3 is fixed on valve housing 2 with the aid of a, for example form-fit, joint.

The injector furthermore includes a closing element 5, in this preferred exemplary embodiment in the form of a valve needle which is linearly movable in the axial direction of the injector along an injector center line X-X. Injector 1 furthermore also includes a return element 6, in this exemplary embodiment in the form of a mechanical spring, which holds closing element 5 in the closed position shown in FIG. 1.

Closing element 5 is actuated with the aid of an actuator 7, in this exemplary embodiment a magnetic actuator. Reference numeral 8 denotes an electrical connection.

Fuel is conducted in the interior of injector 1 to the end of closing element 5 on valve seat 3.

In FIGS. 1 and 2, valve seat 3 is situated upstream from a free injection volume (not entirely illustrated here), for example to a combustion chamber, into which the fluid to be injected, for example a fuel, is injected when the valve is not in a closed state.

As is shown in particular in FIG. 2, valve seat 3 is provided with multiple through-openings 30, which may be released and closed by closing element 5 on a seal seat 50. Like FIG. 1, FIG. 2 also shows the closed state of the injector.

As is furthermore apparent from FIG. 2, in this exemplary embodiment seal seat 50 in valve seat 3, at the injection-side end, designed as a valve ball here, of closing element 5, additionally includes a narrow-volume fluid reservoir area 40. Fluid reservoir area 40 is designed as an area recessed flat in seal seat 50.

The optionally provided fluid reservoir area 40 is primarily used for the continuous flow of a thin fluid film. In this way, in particular continuous wetting and a more even local pressure behavior are ensured.

In this cross section shown here, two through-openings 30 are apparent in the shown section plane of the cross-sectional view, which corresponds to a generally possible exemplary embodiment.

Two through-openings 30 each have a main axis 300.

With main axis 300, through-openings 30 are inclined with respect to injector center line X-X of the injector with an angle of inclination ß. In the specific embodiment shown here, angle of inclination ß is 30° equally for both apparent through-openings 30.

However, generally it is also possible for at least one or each of through-openings 30 to be aligned at a different angle of inclination ß.

Figure 3:
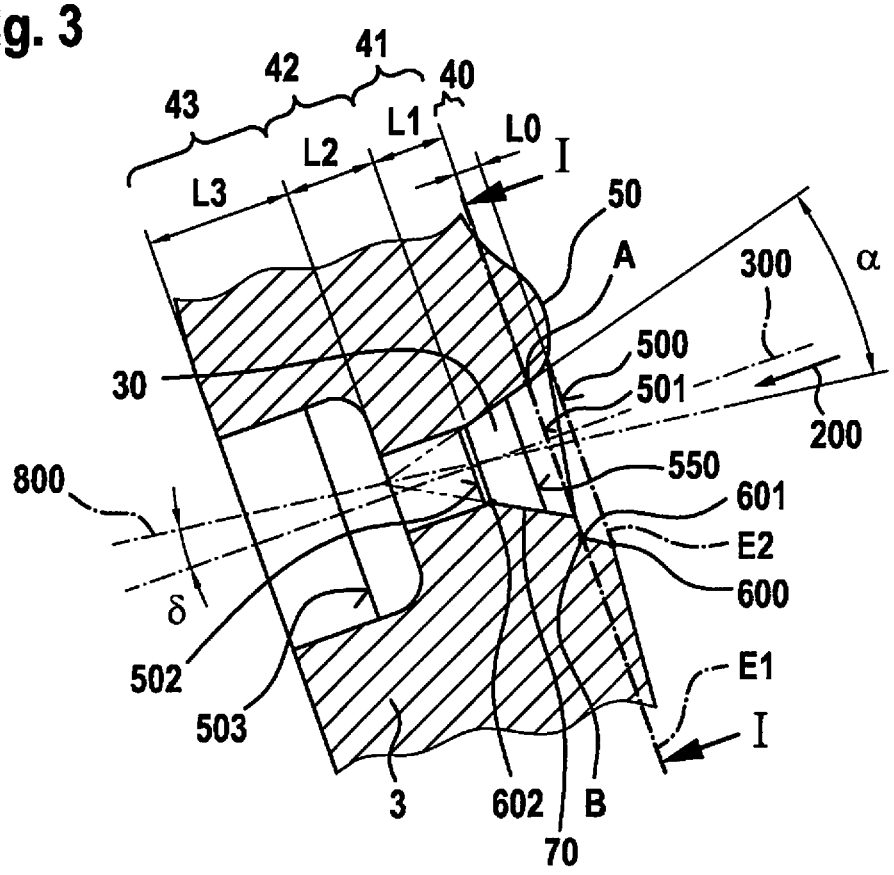
FIG. 3 shows a schematic, enlarged sectional view of a through-opening from FIG. 2.

Fluid to be injected flows through through-openings 30 in a respective flow direction 200, see FIGS. 2 and 3.

The individual jets of fluid generated per through-opening 30 (not shown here) usually form so-called spray lobes, made up of very fine primary and secondary drops, as a result of atomization effects, during their flow exit due to flow separation from the respective circumferential inner walls and exit edges.

Figure 4:
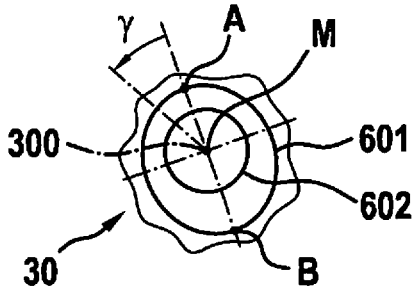
FIG. 4 shows a schematic top view in the flow direction onto an inflow area of the through-opening from FIG. 3.

FIG. 3 illustrates a through-opening 30 as a detail from FIG. 2 in the manner of a schematic sectional view. FIG. 4 assigned to FIG. 3, in turn, shows the corresponding top view projection onto through-opening 30 situated in seal seat 50, viewed in flow direction 200.

The geometric arrangement, in particular with respect to respective angle of inclination ß, and the inner configuration of through-openings 30 hydrodynamically influence the flow behavior of the fluid through through-openings 30 and, downstream therefrom, its injection behavior.

As is apparent, in particular, based on the preferred specific embodiment of a through-opening 30 shown in FIG. 3, the respective inner flow cross sections 550 are variable along flow direction 200.

And in particular, a distinction is to be made here between a total of four discrete flow areas 40, 41, 42, 43 characterized by different flow cross sections.

On the one hand, through-opening 30 is positioned in the preferably present fluid reservoir area 40.

Fluid reservoir area 40 is recessed in seal seat 50 in the form of a flat, convex depression, resulting in a fluid reservoir length L0 corresponding to the depression depth along main axis 300 of through-opening 30.

Perpendicular to main axis 300, a section plane of fluid reservoir area 40 denoted as plane E2 is apparent in seal seat 50, in which a fluid reservoir flow cross section 500 is present.

At its circumference, fluid reservoir flow cross section 500 marks a fluid reservoir circumferential contour 600 in plane E2.

On the other hand, it is apparent in FIG. 3 that through-opening 30 itself is to be subdivided into its own three flow areas 41, 42, 43.

Through-opening 30 shown in FIG. 3, for example, includes an inflow area 41 having an entrance flow cross section 501 in flow direction 200 downstream from fluid reservoir area 40.

By definition, entrance flow cross section 501 of inflow area 41 ends up in a section plane through valve seat 3 denoted as plane E1. Plane E1 denotes a plane which is offset downstream in parallel from plane E2, which thus is also spanned perpendicularly to main axis 300.

In plane E1, entrance flow cross section 501 on its circumference describes an entrance circumferential contour 601 of inflow area 41.

It shall be noted at this point that at least one inner body edge of through-opening 30, in particular one situated in inflow area 41 and/or fluid reservoir area 40, in particular at least one circumferential contour 600, 601, 602, may be provided with a small radius and/or a 45° chamfer. A flow passage area which is thus further rounded is used to reduce hydrodynamically undesirable effects, such as flow separation and/or cavitation.

In the preferred specific embodiment shown in FIGS. 3 and 4, entrance flow cross section 501 of inflow area 41 is smaller than fluid reservoir flow cross section 500 of fluid reservoir area 40. Furthermore, in the projection direction to main axis 300, entrance flow cross section 501 falls completely into the larger fluid reservoir flow cross section 500, so that circumferential contours 600 and 601 do not intersect.

It shall be noted at this point that this geometric configuration shall not be considered to be limiting to the present invention. However, in further preferred specific embodiments, at least a predominant proportion, preferably greater than 90%, of entrance flow cross section 501 falls into the larger fluid reservoir flow cross section 500.

Moreover, through-opening 30 in flow direction 200 downstream from inflow area 41 includes an intermediate flow area 42 having an intermediate flow cross section 502.

Furthermore, through-opening 30 in flow direction 200 downstream from intermediate flow area 42 includes an exit flow area 43 having an exit flow cross section 503.

As is furthermore apparent from FIG. 3, an inflow length L1 results for inflow area 41, an intermediate length L2 results for intermediate flow area 42, and an exit length L3 results for exit flow area 43. As a result, both intermediate flow area 42 along the entire intermediate length L2, and exit flow area 43 along the entire exit length L3, are designed cylindrically with respect to the main axis.

The narrowest flow cross section 550 of through-opening 30 is situated in intermediate flow area 42 and is thus determined by intermediate flow cross section 502.

As is apparent particularly well from FIG. 3, in this preferred specific embodiment through-opening 30 may thus be designed as a typical round borehole in its flow area situated downstream from inflow flow area 41, which expands further in its borehole cross section in flow direction 200 due to an inner projection.

In the preferred specific embodiment, inflow length L1 and intermediate length L2 are similar in size or equal in size with respect to one another.

Furthermore, exit length L3 in terms of the order of magnitude is approximately or identically equal to the overall distance made up of inflow length L1 and intermediate length L2.

According to the present invention, a tapering design of inflow area 41 of at least one through-opening 30 has proven to be particularly advantageous. It is apparent for through-openings 30 shown equally in FIGS. 1 through 3, for example, that entrance flow cross section 501 is selected to be greater than intermediate flow cross section 502 downstream.

In the preferred specific embodiment shown here, flow cross section 550 continuously decreases over length L1, i.e., from entrance flow cross section 501 to intermediate flow cross section 502, with linear progression.

Inflow area 41 tapering in a funnel-shaped manner here, as is apparent in particular from FIG. 3, is thus describable as an inner hollow cone, and in particular defined by a taper angle $\alpha$ of the inner wall to a cone center line 800.

As shown, in particular, in FIG. 3, the above-described linear progression is not only established by taper angle $\alpha$ alone, but additionally by a tilt angle $\delta$.

This is because tilt angle $\delta$ denotes the intersecting angle between cone center line 800 and main axis 300 of through-opening 30. Tilt angle $\delta$ thus relates to a measure for the inclination of inner hollow cone of tapering, in a funnel-shaped manner in FIG. 3, inflow area 41 with respect to main axis 300 of through-opening 30.

In particular, taper angle $\alpha$ and tilt angle $\delta$ are thus decisively determinative for the geometry of tapering inflow area 41 of through-opening 30, and thus for the inflow behavior of the fluid to be injected.

In an alternative specific embodiment not shown here, tilt angle $\delta$ may also be selected to be zero, so that cone center line 800 and main axis 300 of through-opening 30 coincide. With such an alternative specific embodiment, a round entrance circumferential contour 601 of inflow area 41 results in the section with a plane E1 spanned by entrance flow cross section 501. A center of a circle M of round entrance circumferential contour 601 is thus situated in the intersecting point of cone center line 800 or of main axis 300 with plane E1.

However, a preferred specific embodiment is present in FIG. 3, together with the associated view of FIG. 4, in which the geometric configuration of a, rotation-symmetrical, inner hollow cone with an inclination with respect to the main axis of the through-opening by a tilt angle $\delta$ of approximately ten angular degrees is shown.

This section of the obliquely inclined inner hollow cone with plane E1 of entrance flow cross section 501 geometrically results in an oval entrance circumferential contour 601.

The resulting oval entrance circumferential contour 601 is apparent particularly well from FIG. 4.

Furthermore, the positions, by definition, of two characterizing points A, B along entrance circumferential contour 601, which span the oval, are noted in the illustration of FIG. 4. On the one hand, this is a first circumferential point A closest to main axis 300 of through-opening 30. On the other hand, a second circumferential point B situated the farthest from the main axis of the through-opening is plotted.

As is furthermore apparent from FIG. 4, an angle coordinate denoted as inscribed angle $\gamma$ runs about main axis 300 in plane E1, starting at first circumferential point A set as the zero point.

In the preferred specific embodiment, as is plotted in FIG. 4, second circumferential point B is thus situated with respect to first circumferential point A at a inscribed angle $\gamma$ equal to 180°.

Here, the clockwise rotation about center point M marking main axis 300 is plotted as the sense of rotation of inscribed angle $\gamma$.

Further embodiments provide that taper angle $\alpha$ is designed to be variable with inscribed angle $\gamma$ as a function of the inscribed angle. In this way, the tapering inflow area is then designed as an oblique inner hollow cone.

What is claimed is:

1. An injector for injecting a fluid, comprising:

a valve housing;

a valve seat on which a sealing area is situated, wherein the valve seat is fixed on the valve housing;

a closing element, situated on an injector center line, to release and close a plurality of through-openings at the valve seat, each of the plurality of the through-openings including a main axis at an angle of inclination with respect to the injector center line, the through-openings including an inflow area, and the inflow area having a tapered configuration; and a return element to hold the closing element in a closed position;

wherein the closing element includes a valve needle, which is linearly movable in an axial direction of the injector along the injector center line, wherein the closing element is actuated with an actuator, wherein there is a seal seat in the valve seat, at an injection-side end, configured as a valve ball, of the closing element, includes a fluid reservoir area that is recessed flat in the seal seat, wherein each of two through-openings are inclined with respect to the injector center line of the injector with the respective angle of inclination, wherein the fluid reservoir area is recessed in the seal seat in the form of a convex depression, resulting in a fluid reservoir length corresponding to a depression depth along one of the main axes of the plurality of the through-openings, wherein perpendicular to one of the main axes, a first section plane of the fluid reservoir area is in the seal seat, in which a fluid reservoir flow cross section is present, wherein at its circumference, the fluid reservoir flow cross section marks a fluid reservoir circumferential contour in the first section plane, wherein each of the through-openings is subdivided into three flow areas, wherein the three flow areas include the inflow area having an entrance flow cross section in a flow direction downstream from the fluid reservoir area, and wherein each of the through-openings in a flow direction downstream from an intermediate flow area includes an exit flow area having an exit flow cross section, wherein an intermediate flow cross section is less than the exit flow area, wherein each of the through-openings, in a flow direction downstream from the inflow area, includes the intermediate flow area having the intermediate flow cross section, and downstream from the intermediate flow area includes the exit flow area having the exit flow cross section, the intermediate flow cross section being a narrowest flow cross section of the through-opening, wherein an inflow length results for the inflow area, an intermediate length results for the intermediate flow area, and an exit length results for the exit flow area, so that as a result, the intermediate flow area along the entire intermediate length, and the exit flow area along the entire exit length, are symmetrical cylindrical shapes with respect to corresponding ones of the main axes, wherein a narrowest flow cross section of the through-opening is situated in the intermediate flow area and is determined by the intermediate flow cross section, wherein at least one inner body edge of the through-opening, is situated in the inflow area and/or the fluid reservoir area, so that at least one circumferential contour is provided with a radius and a chamfer, and wherein the entrance flow cross section of the inflow area is in a second section plane through the valve seat, wherein the second section plane is offset downstream in parallel from the first section plane, which is spanned perpendicularly to a corresponding one of the main axes.

2. The injector as recited in claim 1, wherein the entrance flow cross-section of the inflow area situated transversely to the main axis continuously decreases in a flow direction.

3. The injector as recited in claim 1, wherein the inflow area is configured as an inner hollow cone having a taper angle of an inner wall with respect to a cone center line.

4. The injector as recited in claim 3, wherein the cone center line intersects the main axis of the through-opening at a tilt angle.

5. The injector as recited in claim 1, wherein the entrance flow cross section of the inflow area defining the second section plane includes a non-circular entrance circumferential contour in the second section plane.

6. The injector as recited in claim 5, wherein the entrance circumferential contour has an oval configuration in the second section plane.

7. The injector as recited in claim 6, wherein the entrance circumferential contour, in the second section plane, includes a first circumferential point closest to the main axis of the through-opening, which defines an inscribed angle equal to zero in the second section plane about the main axis, and a second circumferential point situated the farthest away from the main axis of the through-opening, which is situated at an inscribed angle equal to 180°, and a taper angle is configured to be variable with the inscribed angle.

8. The injector as recited in claim 1, wherein the intermediate flow area and/or the exit flow area is configured to be cylindrical with respect to the main axis.

9. The injector as recited in claim 1, wherein the inflow length and the intermediate length being about equal in size with respect to one another and/or the exit length being greater than the inflow length and/or the intermediate length approximately by a factor of 1.3 to 2.3.

10. The injector as recited in claim 9, wherein the factor is 1.4 to 1.7.

* * * * *